US011715409B2

(12) United States Patent
Fu

(10) Patent No.: US 11,715,409 B2
(45) Date of Patent: Aug. 1, 2023

(54) DRIVING CIRCUIT

(71) Applicant: TCL China Star Optoelectronics Technology Co., Ltd., Shenzhen (CN)

(72) Inventor: Xiaoli Fu, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/625,689

(22) PCT Filed: Dec. 10, 2019

(86) PCT No.: PCT/CN2019/124400
§ 371 (c)(1),
(2) Date: Dec. 21, 2019

(87) PCT Pub. No.: WO2021/103140
PCT Pub. Date: Jun. 3, 2021

(65) Prior Publication Data

US 2022/0415242 A1 Dec. 29, 2022

(30) Foreign Application Priority Data

Nov. 28, 2019 (CN) ..... 201911187688.8

(51) Int. Cl.
*G09G 3/20* (2006.01)

(52) U.S. Cl.
CPC ... *G09G 3/2096* (2013.01); *G09G 2300/0408* (2013.01); *G09G 2310/0289* (2013.01); *G09G 2310/08* (2013.01)

(58) Field of Classification Search
CPC ..... G09G 3/2096; G09G 2300/0408; G09G 2310/0289; G09G 2310/08
See application file for complete search history.

(56) References Cited

U.S. PATENT DOCUMENTS

2012/0133627 A1 5/2012 Moon
2016/0335968 A1 11/2016 Zeng et al.
2017/0186397 A1 6/2017 Smith et al.
(Continued)

FOREIGN PATENT DOCUMENTS

CN 102479494 A 5/2012
CN 104680991 A 6/2015
CN 105304035 A 2/2016
(Continued)

*Primary Examiner* — Doon Y Chow
(74) *Attorney, Agent, or Firm* — PV IP PC; Wei Te Chung; Zhigang Ma

(57) ABSTRACT

A driving circuit that includes a timing controller, a selecting module connected to the timing controller, and a level shifter connected to the selecting module, wherein the timing controller includes N pins, each of the pins provides a clock signal, and N is a positive integer; the selecting module includes N selecting units, an input terminal of each of the selecting units is connected to a corresponding pin of the timing controller, output terminals of each of the selecting units are connected to M input pins of the level shifter, and M is greater than or equal to 2. The driving circuit according to the present invention individually passes clock signals of a timing controller through selecting units and outputs to a level shifter, and pins of the timing controller can be substantially saved.

5 Claims, 2 Drawing Sheets

(56) References Cited

U.S. PATENT DOCUMENTS

2018/0211585 A1 7/2018 Huang

FOREIGN PATENT DOCUMENTS

| | | | | |
|---|---|---|---|---|
| CN | 105957491 | A | | 9/2016 |
| CN | 110428767 | A | | 11/2019 |
| CN | 110491328 | A | * | 11/2019 |
| CN | 110491328 | A | | 11/2019 |

* cited by examiner

DRIVING CIRCUIT

FIELD OF INVENTION

The present invention relates to the technical field of display, and especially to a driving circuit.

BACKGROUND OF INVENTION

With continuing development of display technology, people's demand for high contrast, high resolution, narrow border, and thin panels has become stronger. In order to achieve this goal, current mainstream products of display technologies such as liquid crystal displays, organic light-emitting diode displays, etc. widely adopt gate driver on array (GOA) driving circuits as gate driving circuits.

However, in GOA driving circuits, in order to satisfy a requirement of an amount of pins of a level shifter, a timing controller must provide an equal amount of pins, and during a course of practical use, the timing controller usually cannot satisfy this requirement; even if it does pins of the timing controller would be very wastefully used.

SUMMARY OF INVENTION

The present invention provides a driving circuit to resolve the technical problem that in a conventional GOA driving circuit, an amount of pins of a timing controller cannot efficiently satisfy an amount of pins of a level shifter.

In order to resolve the above-mentioned problem, the present invention provides the following technical approach.

The present invention provides a driving circuit that includes a timing controller, a selecting module connected to the timing controller, and a level shifter connected to the selecting module, wherein the timing controller includes N pins, each of the pins provides a clock signal, and N is a positive integer; the selecting module includes N selecting units, an input terminal of each of the selecting units is connected to a corresponding pin of the timing controller, output terminals of each of the selecting units are connected to M input pins of the level shifter, and M is greater than or equal to 2.

According to at least one embodiment of the present invention, each of the selecting units includes M switch transistors, each input terminal of the switch transistors is connected to a corresponding pin of the timing controller, and each output terminal of the switch transistors is connected to a corresponding input pin of the level shifter.

According to at least one embodiment of the present invention, the driving circuit further includes a control unit, wherein the control unit includes M output terminals connected to control terminals of the M switch transistors, respectively, to control an on/off state of the M switch transistors.

According to at least one embodiment of the present invention, each of the selecting units includes two switch transistors, a first switch transistor and a second switch transistor, input terminals of the first switch transistor and the second switch transistor are connected to a same corresponding pin of the timing controller, and output terminals of the first switch transistor and the second switch transistor are connected to a corresponding input pin of the level shifter, respectively.

According to at least one embodiment of the present invention, the control unit includes two output terminals electrically connected to the first switch transistors and the second switch transistors, respectively, to control an on/off state of the first switch transistors and the second switch transistors; the control unit controls the first switch transistors to turn on such that the timing controller outputs the clock signal sequentially to corresponding input pins of the level shifter connected to output terminals of the first switch transistors through the first switch transistors; the control unit controls the first switch transistors to turn off after delaying a first time when the first switch transistors are turned on, and controls the second switch transistors to turn on such that the timing controller outputs the clock signal sequentially to corresponding input pins of the level shifter connected to output terminals of the second switch transistors through the second switch transistors.

According to at least one embodiment of the present invention, the driving circuit further includes a delay unit, wherein an input terminal of the delay unit is electrically connected to a second output terminal of the control unit, and an output terminal of the delay unit is electrically connected to control terminals of the second switch transistors.

According to at least one embodiment of the present invention, the driving circuit is a gate driver on array (GOA) driving circuit.

According to at least one embodiment of the present invention, the first switch transistors and the second switch transistors are metal-oxide-semiconductor field-effect transistors (MOSFETs).

According to at least one embodiment of the present invention, the first switch transistors and the second switch transistors are n-type MOSFETs.

According to at least one embodiment of the present invention, the first switch transistors and the second switch transistors are p-type MOSFETs.

The driving circuit according to the present invention, by modifying a control circuit, individually passes clock signals of a timing controller through selecting units and outputs to a level shifter. Because of repeated use of pins of the timing controller, pins of the timing controller can be substantially saved.

DESCRIPTION OF DRAWINGS

In order to further understand features and technical contents of the present invention, please refer to the following detailed description and accompanying drawings of the present invention. However, the accompanying drawings are used for purpose of explanation and do not limit the present invention.

With reference to the following drawings, the technical approach and other beneficial effects of the present invention will be obvious through describing embodiments of the present invention in detail.

The drawings are as the following.

FIG. 1 is a schematic diagram of a driving circuit according to the present invention.

FIG. 2 is a timing diagram of clock signals input to a panel by the driving circuit according to the present invention.

DETAILED DESCRIPTION OF PREFERRED EMBODIMENTS

In order to further describe the technical approach and the effects of the present invention, the following describes in detail with reference to advantageous embodiments and the accompanying drawings of the present invention.

The present invention directs to the technical problem that in a conventional gate driver on array (GOA) driving circuit, an amount of pins of a timing controller cannot efficiently satisfy an amount of pins of a level shifter, and the present embodiment can resolve this drawback.

Figure 1:
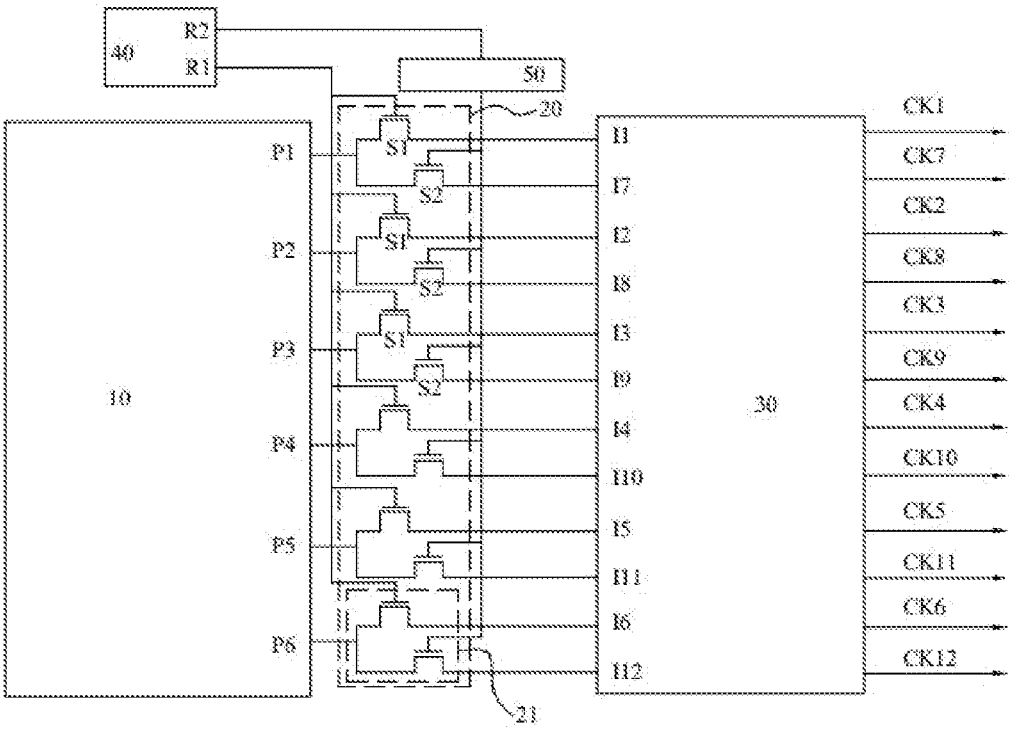

FIG. 1 is a schematic diagram of a driving circuit according to the present invention. The driving circuit includes a timing controller 10, a selecting module 20 connected to the timing controller 10, and a level shifter 30 connected to the selecting module 20, wherein the timing controller 10 includes N pins P, each of the pins P provides a clock signal, and N is a positive integer; the selecting module 20 includes N selecting units 21, an input terminal of each of the selecting units 21 is connected to a corresponding pin P of the timing controller 10, output terminals of each of the selecting units 21 are connected to M input pins I of the level shifter 30, and M is greater than or equal to 2.

Each of the selecting units 21 includes M switch transistors, each input terminal of the switch transistors is connected to a corresponding pin P of the timing controller 10, and each output terminal of the switch transistors is connected to a corresponding input pin I of the level shifter 30.

The driving circuit further includes a control unit 40, wherein the control unit 40 includes M output terminals connected to control terminals of the M switch transistors, respectively, to control an on/off state of the M switch transistors.

The selecting module 20 is constituted by the selecting units 21. In the present embodiment, each of the selecting units 21 includes two switch transistors, a first switch transistor S1 and a second switch transistor S2, input terminals of the first switch transistor S1 and the second switch transistor S2 are connected to a same corresponding pin P of the timing controller 10, and output terminals of the first switch transistor S1 and the second switch transistor S2 are connected to a corresponding input pin I of the level shifter 30, respectively. The first switch transistors S1 and the second switch transistors S2 are metal-oxide-semiconductor field-effect transistors (MOSFETs). In one embodiment, the first switch transistors S1 and the second switch transistors S2 are n-type MOSFETs. In other embodiments, the first switch transistors S1 and the second switch transistors S2 can also be p-type MOSFETs.

The timing controller 10 provides clock signals through the N pins P. In the present embodiment, an amount of the pins P is six; however, an amount of the pins P can also be other amounts. The pins P have clock signals different from each other in phase. In the present embodiment, a clock signal of the pin P2 lags with respect to a clock signal of the pin P1 in phase, a clock signal of the pin P3 lags with respect to a clock signal of the pin P2 in phase, and so on.

Figure 2:
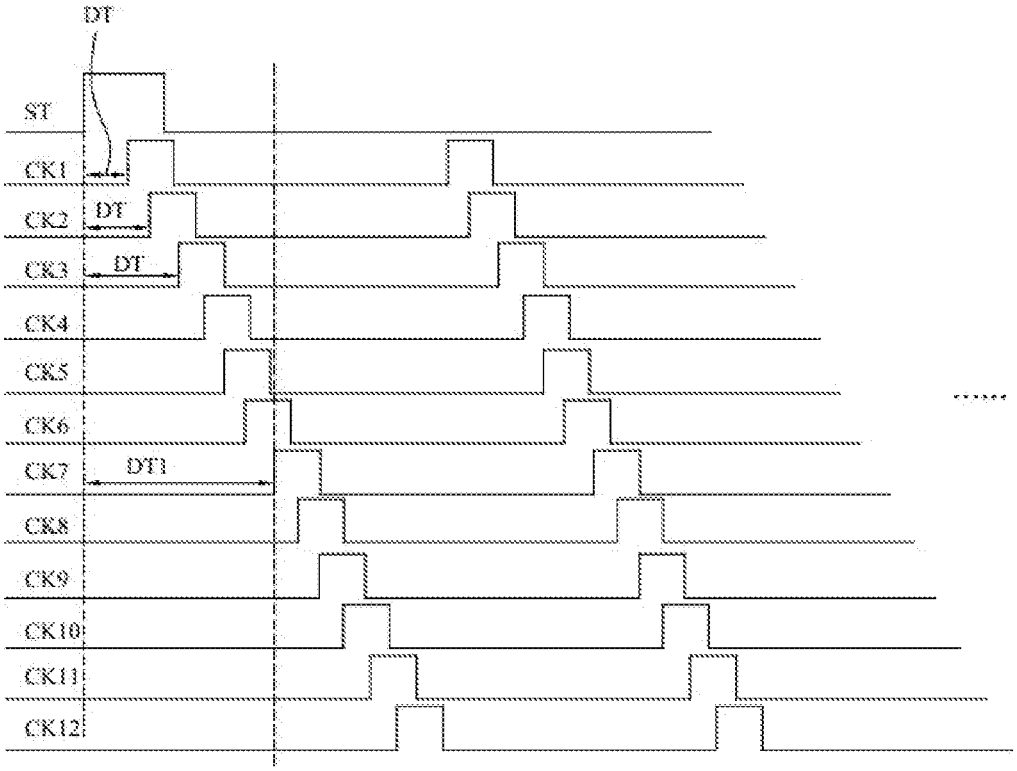

FIG. 2 is a timing diagram of clock signals input to a panel by the driving circuit according to the present invention. After a rising edge of a start signal ST, the timing controller 10 begins to provide clock signals, the pins P have clock signals different from each other in phase, and hence the clock signals have several delay times DT with respect to the start signal ST. When the first switch transistor S1 is turned on, clock signals of the pins P are transmitted to a part of the input pins I, I1-I6, and after passing through the level shifter 30, waveforms of CK1-CK6 in FIG. 2 are output.

The control unit 40 includes two output terminals electrically connected to the first switch transistors S1 and the second switch transistors S2, respectively, to control an on/off state of the first switch transistors S1 and the second switch transistors S2; the control unit 40 controls the first switch transistors S1 to turn on such that the timing controller 10 outputs the clock signal sequentially to corresponding input pins of the level shifter 30 connected to output terminals of the first switch transistors S1 through the first switch transistors S1; the control unit 40 controls the first switch transistors S1 to turn off after delaying a first time DT1 when the first switch transistors S1 are turned on, and controls the second switch transistors S2 to turn on such that the timing controller 10 outputs the clock signal sequentially to corresponding input pins I of the level shifter 30 connected to output terminals of the second switch transistors S2 through the second switch transistors S2.

When the second switch transistor S2 is turned on, clock signals of the pins P are transmitted to the rest of the input pins I, I7-I12, and after passing through the level shifter 30, waveforms of CK7-CK12 in FIG. 2 are output. The driving circuit further includes a delay unit 50, wherein an input terminal of the delay unit 50 is electrically connected to a second output terminal R2 of the control unit 40, and an output terminal of the delay unit 50 is electrically connected to control terminals of the second switch transistors S2.

Beneficial effects: The driving circuit according to the present invention, by modifying a control circuit, individually passes clock signals of a timing controller through selecting units and outputs to a level shifter. Because of repeated use of pins of the timing controller, pins of the timing controller can be substantially saved.

Although the present invention has been explained in relation to its preferred embodiment, it does not intend to limit the present invention. It is obvious to those skilled in the art having regard to this present invention that other modifications of the exemplary embodiments beyond these embodiments specifically described here may be made without departing from the spirit of the invention. Accordingly, such modifications are considered within the scope of the invention as limited solely by the appended claims.

What is claimed is:

1. A driving circuit, comprising a timing controller, a selecting module connected to the timing controller, and a level shifter connected to the selecting module, wherein:

the timing controller comprises N pins, each of the pins provides a clock signal, the N pins have clock signals different from each other in phase, and N is a positive integer;

the selecting module comprises N selecting units, an input terminal of each of the selecting units is connected to a corresponding pin of the timing controller, output terminals of each of the selecting units are connected to M input pins of the level shifter, and M is greater than or equal to 2;

each of the selecting units comprises two switch transistors, a first switch transistor and a second switch transistor, input terminals of the first switch transistor and the second switch transistor are connected to a same corresponding pin of the timing controller, and output terminals of the first switch transistor and the second switch transistor are connected to a corresponding input pin of the level shifter, respectively;

the driving circuit further comprises a control unit, the control unit comprises two output terminals connected to control terminals of the two switch transistors, respectively, to control an on/off state of the w switch transistors;

the driving circuit further comprises a delay unit, an input terminal of the delay unit is electrically connected to a second output terminal of the control unit, and an output terminal of the delay unit is electrically connected to control terminals of the second switch transistors.

2. The driving circuit as claimed in claim 1, wherein the driving circuit is a gate driver on array (GOA) driving circuit.

3. The driving circuit as claimed in claim 1, wherein the first switch transistors and the second switch transistors are metal-oxide-semiconductor field-effect transistors (MOSFETs).

4. The driving circuit as claimed in claim 3, wherein the first switch transistors and the second switch transistors are n-type MOSFETs.

5. The driving circuit as claimed in claim 3, wherein the first switch transistors and the second switch transistors are p-type MOSFETs.

* * * * *